US008864410B1

(12) United States Patent
Kopacz et al.

(10) Patent No.: US 8,864,410 B1
(45) Date of Patent: Oct. 21, 2014

(54) SCREED WALKWAY

(71) Applicant: Caterpillar Paving Products Inc., Brooklyn Park, MN (US)

(72) Inventors: Jason W. Kopacz, St. Louis Park, MN (US); Jameson M. Smieja, Mound, MN (US); Steven M. Haas, Shakopee, MN (US); Kevin J. Magee, Buffalo, MN (US); Anthony P. Steinhagen, Minneapolis, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/855,763

(22) Filed: Apr. 3, 2013

(51) Int. Cl.
*E01C 19/22* (2006.01)
*E01C 19/42* (2006.01)

(52) U.S. Cl.
CPC ..... *E01C 19/42* (2013.01)
USPC ..... 404/118

(58) Field of Classification Search
USPC ..... 404/83, 118, 102
See application file for complete search history.

(56) References Cited

U.S. PATENT DOCUMENTS

| | | | | | |
|---|---|---|---|---|---|
| 2,303,812 | A | * | 12/1942 | Barber | 404/95 |
| 2,351,593 | A | * | 6/1944 | Barber | 404/96 |
| 2,914,994 | A | * | 12/1959 | Pollitz | 404/96 |
| 2,951,426 | A | * | 9/1960 | Pollitz | 404/95 |
| 2,957,254 | A | * | 10/1960 | Bederman et al. | 37/381 |
| 3,272,099 | A | * | 9/1966 | Drake | 404/84.2 |
| 3,286,606 | A | * | 11/1966 | Layton | 404/95 |
| 3,482,494 | A | * | 12/1969 | Jennings, Jr. | 404/110 |
| 3,557,672 | A | * | 1/1971 | Shurtz et al. | 404/95 |
| 3,636,832 | A | * | 1/1972 | Schrimper et al. | 404/84.2 |
| 4,379,653 | A | * | 4/1983 | Brown | 404/118 |
| 4,496,265 | A | * | 1/1985 | Fragale | 404/110 |
| 4,702,642 | A | | 10/1987 | Musil | |
| 7,413,377 | B2 | * | 8/2008 | Pontano, III | 404/118 |
| 8,221,025 | B2 | * | 7/2012 | Buschmann et al. | 404/75 |
| 2010/0150651 | A1 | | 6/2010 | Buschmann et al. | |
| 2010/0209190 | A1 | | 8/2010 | Munz et al. | |

* cited by examiner

*Primary Examiner* — Gary Hartmann
(74) *Attorney, Agent, or Firm* — Miller, Matthias & Hull; Andrew A. Phillips

(57) ABSTRACT

A walkway for a screed includes a main walkway and an extender walkway coupled to the main walkway and an extender frame of the screed. The extender walkway is slidable relative to the main walkway along a sliding direction. Further, the extender walkway and the extender frame are pivotable relative to each other about a walkway pivot axis, the walkway pivot axis being substantially perpendicular to the sliding direction.

21 Claims, 13 Drawing Sheets

SCREED WALKWAY

TECHNICAL FIELD

The present disclosure relates to a screed, and more particularly to a walkway for the screed.

BACKGROUND

A screed of a paving machine includes a main screed and two extender screeds, one on each side of the main screed, that may extend or retract relative to the main screed. The main screed and extender screeds are adjustable to form various paving configurations. A walkway is connected to the screed. The walkway may enable one or more operators to observe the paving operation, and also operate and control various functions of the screed.

U.S. Pat. Pub. No. 2010/0150651 to Joseph Voegele AG discloses a paving screed comprising a base screed and extension screeds. Each extension screed is supported via an extension guiding structure at a guidance fixed in the base screed such that each extension screed can be extended and retracted. A multiple point suspension is provided between the extension guiding structure and the guidance. A frame carrying the sole plate of the extension screed is arranged below the extension guiding structure. Substantially vertical adjustment assemblies make it possible to adjust the height position of the frame via drives. A lateral inclination adjustment assembly is provided structurally separated from the adjustment assemblies either for the frame or within the frame for the sole plate of the extension screed. However, the Voegele reference does not disclose a walkway for the paving screed.

SUMMARY

In one aspect, the present disclosure provides a walkway for a screed. The walkway includes a main walkway and an extender walkway coupled to the main walkway and an extender frame of the screed. The extender walkway is slidable relative to the main walkway along a sliding direction. Further, the extender walkway and the extender frame are pivotable relative to each other about a walkway pivot axis, the walkway pivot axis being substantially perpendicular to the sliding direction.

In another aspect, the present disclosure provides a screed including a main frame; an extender frame configured to be retractable and extendable relative to the main frame, and a walkway. The walkway includes a main walkway, and an extender walkway coupled to the main walkway and the extender frame. The extender walkway is slidable relative to the main walkway along a sliding direction. Further, the extender walkway and the extender frame are pivotable relative to each other about a walkway pivot axis substantially perpendicular to the sliding direction.

In yet another aspect, the present disclosure provides a paving machine including a main frame; an extender frame configured to be retractable and extendable relative to the main frame, and a walkway. The walkway includes a main walkway, and an extender walkway coupled to the main walkway and the extender frame. The extender walkway is slidable relative to the main walkway along a sliding direction. Further, the extender walkway and the extender frame are pivotable relative to each other about a walkway pivot axis substantially perpendicular to the sliding direction.

Other features and aspects of this disclosure will be apparent from the following description and the accompanying drawings.

DETAILED DESCRIPTION

Figure 1:
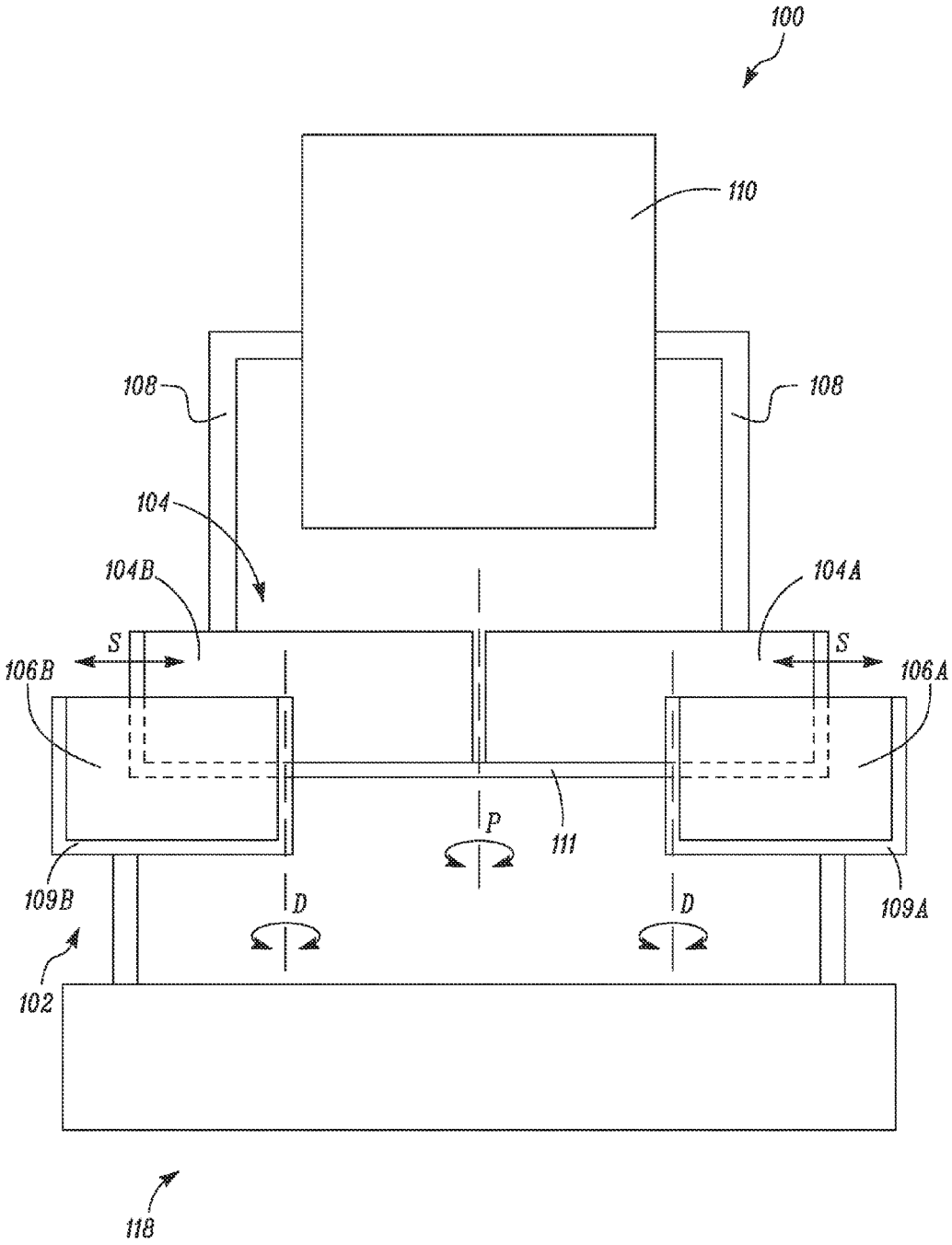
FIG. 1 illustrates a schematic top view of a paving machine having a screed.
Figure 2:
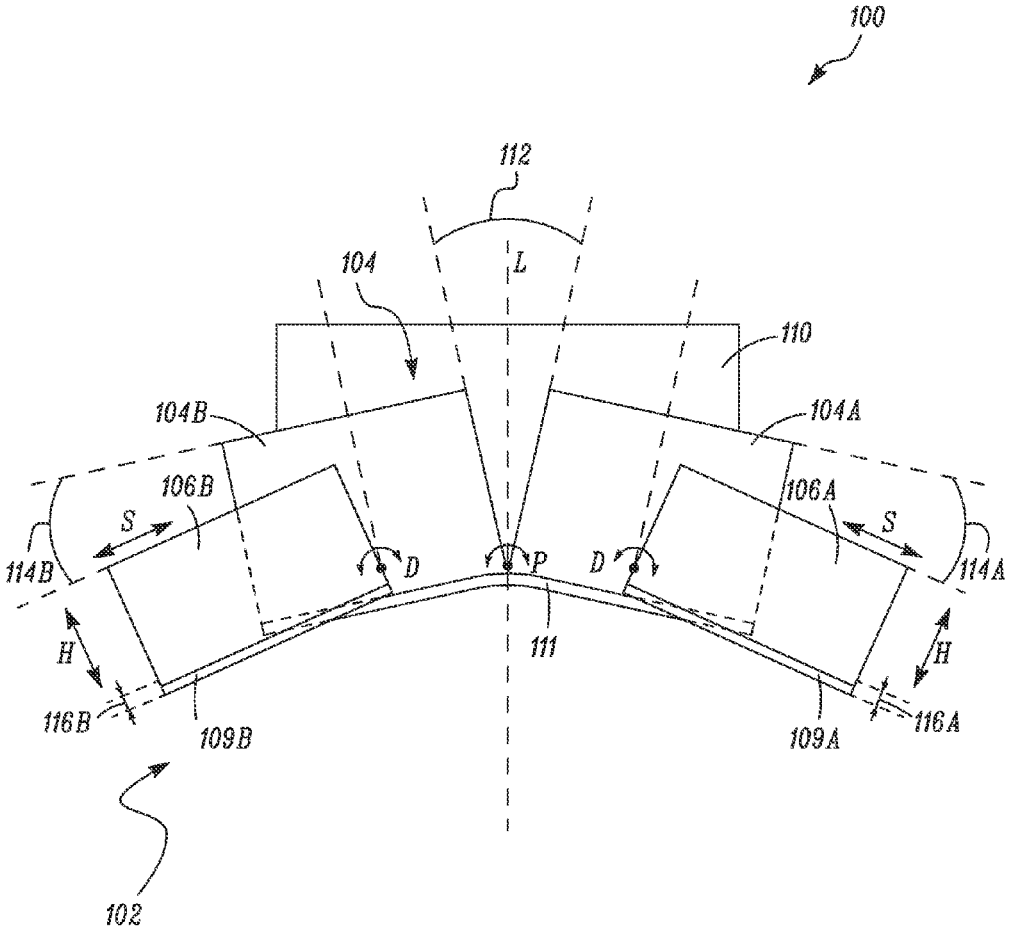
FIG. 2 illustrates a schematic rear view of the paving machine of FIG. 1.

The present disclosure describes a screed of a paving machine. FIG. 1 and FIG. 2 illustrate a schematic view of a paving machine 100, according to an embodiment of the present disclosure. The paving machine 100 includes a screed 102 having a main screed 104 and, first and second extender screeds 106A, 106B. The main screed 104 is flexibly coupled to a tractor 110 by tow arms 108 and follows behind the tractor 110 Further, the first and second extender screeds 106A, 106B are mounted rearwardly of the main screed 104. In other embodiments, the first and second extender screeds 106A, 106B may be mounted either in front of the main screed 104 or even with the main screed 104. The first and second extender screeds 106A, 106B include first and second extender plates 109A, 109B, respectively. Further, the first and second extender screeds 106A, 106B also include first and second extender frames (shown in later FIGS.). In an embodiment, the first and second extender plates 109A, 109B may be connected to the first and second extender frames.

As illustrated in FIG. 1 and FIG. 2, the main screed 104 includes a first main section 104A and a second main section 104B, one on each side of a center line "L" of the main screed 104. The main screed 104 further includes a main plate 111 mounted on the first and second main sections 104A, 104B. The main plate 111 and the first and second extender plates 109A, 109B may be used for compacting and leveling a paving material. One or more heating systems may be associated with the plates 111, 109A, and 109B. Further, the first and second main sections 104A, 104B also include first and second main frames (shown in later FIGS.). In an embodiment, the main plate 111 may be connected to the first and second main frames.

In an embodiment, the first and second main sections 104A, 104B are pivotable about a main pivot axis "P" (hereinafter referred to as the axis "P"). The axis "P" may be substantially located at the center line "L" of the main screed 104. The main plate 111 may elastically deform to accommodate the pivotal motions of the first and the second sections 104A, 104B. An angle between the first or second main sections 104A, 104B may be referred to as a crown angle. Further, the pivoting about the axis "P" may be referred to as a crown motion of each of the first and second main sections 104A, 104B. For example, as shown in FIG. 2, the first main section 104A and the second main section 104B are inclined at the crown angle 112 relative to each other. The first and second main sections 104A, 104B are shown to be pivoted downwards (positive crown motion). However, at least one of the first or second main sections 104A, 104B may pivot upwards (negative crown motion).

The first and second extender screeds 106A, 106B are retractable and extendable relative to the first and second main sections 104A, 104B, respectively, along a sliding direction "S" (hereinafter referred to as the direction "S"). The extension and retraction along the direction "S" may be referred to as a sliding motion of each of the first and second extender screeds 106A, 106B. For example, as shown in FIG. 1 and FIG. 2, the first and second extender screeds 106A, 106B are extended relative to the first and second main sections 104A, 104B, respectively.

The first and second extender screeds 106A, 106B are pivotably adjustable relative to the first and second main sections 104A, 104B, respectively, about a slope axis "D" (hereinafter referred to as the axis "D"). Thus, the first and second extender plates 109A, 109B are also pivotably adjustable relative to the main plate 111. In an embodiment, the axis "D" may be substantially parallel to the axis "P". An angle between the first or second extender screeds 106A, 106B, and the first or second main sections 104A, 104B, respectively, may be referred to as a slope angle. The pivoting about the axis "D" may be referred to as a slope motion of each of the first and second extender screeds 106A, 106B. For example, as shown in FIG. 2, the first and second extender screeds 106A, 106B are inclined at a first slope angle 114A and a second slope angle 114B relative to the first and second main sections 104A, 104B, respectively. The first and second extender screeds 106A, 106B are shown to be pivoted downwards (positive slope motion). However, at least one of the first or second extender screeds 106A, 106B may pivot upwards (negative slope motion).

The first and second extender plates 109A, 109B are vertically adjustable relative to the main plate 111 along a height direction "H" (hereinafter referred to as the direction "H"). In an embodiment, a vertical adjustment of the first and second extender plates 109A, 109B may be achieved by displacing a portion of each of the first and second extender screeds 106A, 106B with respect to another portion. In an alternative embodiment, each of the first and second extender screeds 106A, 106B may be displaced as a single component. A vertical distance between the first or second extender screeds 106A, 106B, and the first or second main sections 104A, 104B may be referred to as a height. The vertical movement along the direction "H" may be referred to as a height motion of each of the first and second extender screeds 106A, 106B. For example, as shown in FIG. 2, the first and second extender screeds 106A, 106B are located at a first height 116A and a second height 116B relative to the first and second main sections 104A, 104B, respectively. The first and second extender plates 109A, 109B are shown to be vertically displaced in a downward direction. However, at least one of the first or second extender plates 109A, 109B may vertically move in an upward direction.

It is apparent that the crown angle 112, the first and second slope angles 114A, 114B, the first and second heights 116A, 116B, and extension/retraction of the first and second extender screeds 106A, 106B are purely exemplary in nature, and the screed 102 may assume other configurations within the scope of the present disclosure. Varying the aforementioned parameters, such as, but not limited to, the crown angle 112, the first and second slope angles 114A, 114B, the first and second heights 116A, 116B, and/or the extension or retraction of the first and second extender screeds 106A, 106B may enable the screed 102 to pave differently shaped paving surfaces. In various embodiments, a hydraulic system, an electric system, a mechanical system, or a combination thereof may be used to actuate various parts of the screed 102. Further, the screed 102 may include one or more user interfaces (not shown) to enable one or more operators to control and view various parameters.

As shown in FIG. 1, the screed 102 also includes a walkway 118. The walkway 118 is not illustrated in FIG. 2 for clarity. The walkway 118 is connected to first and second extender screeds 106A, 106B. Further, the walkway 118 is located at a height with respect to a paving surface so as not to interfere with a paving operation. The walkway 118 may enable one or more operators to access the one or more user interfaces during a paving operation of the screed 102. Further, the operators may also be able to observe the paving operation closely. Various details of the screed 102 will be described henceforth.

Figure 3:
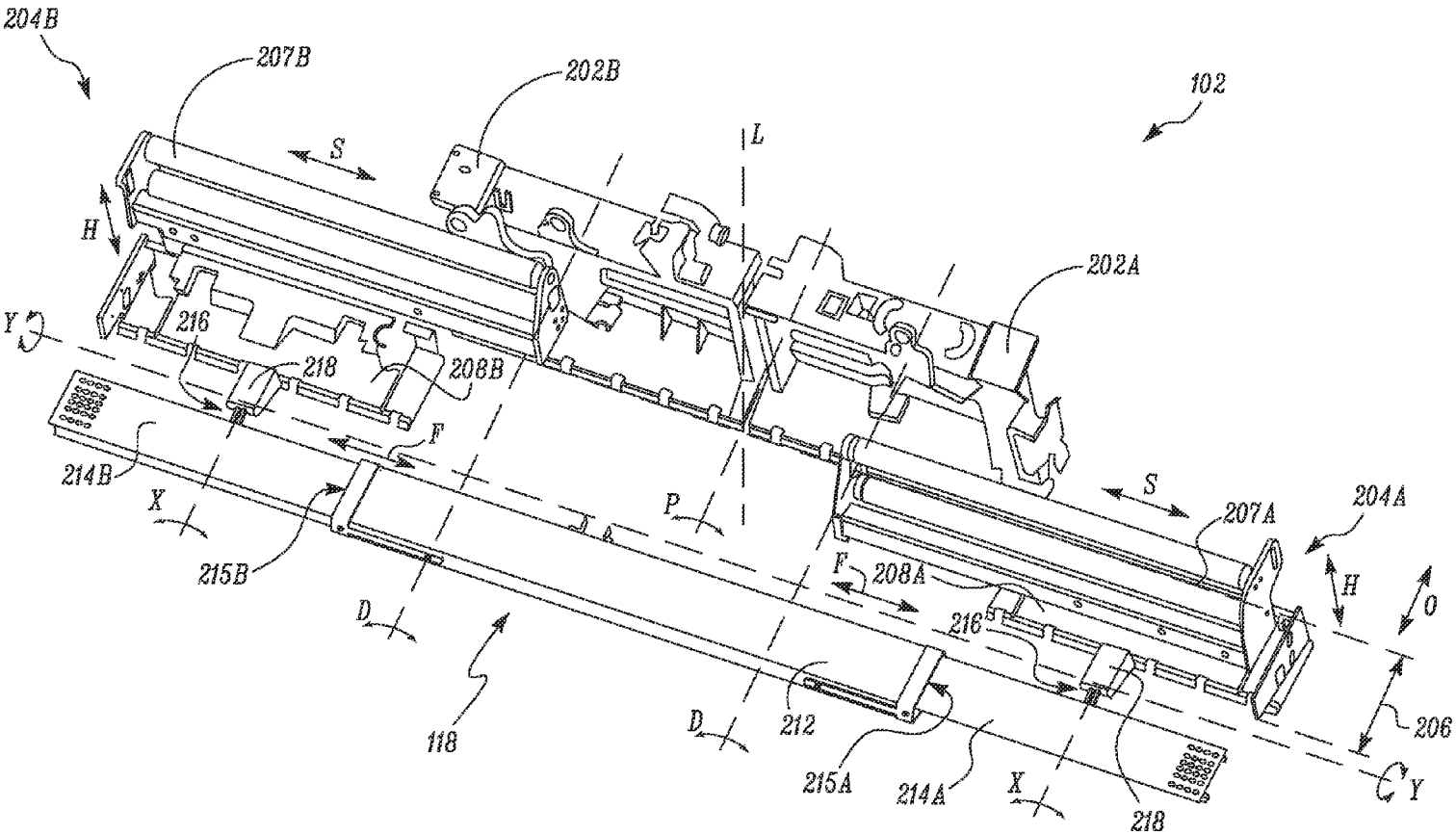
FIG. 3 illustrates a perspective view of the screed having a walkway.
Figure 4:
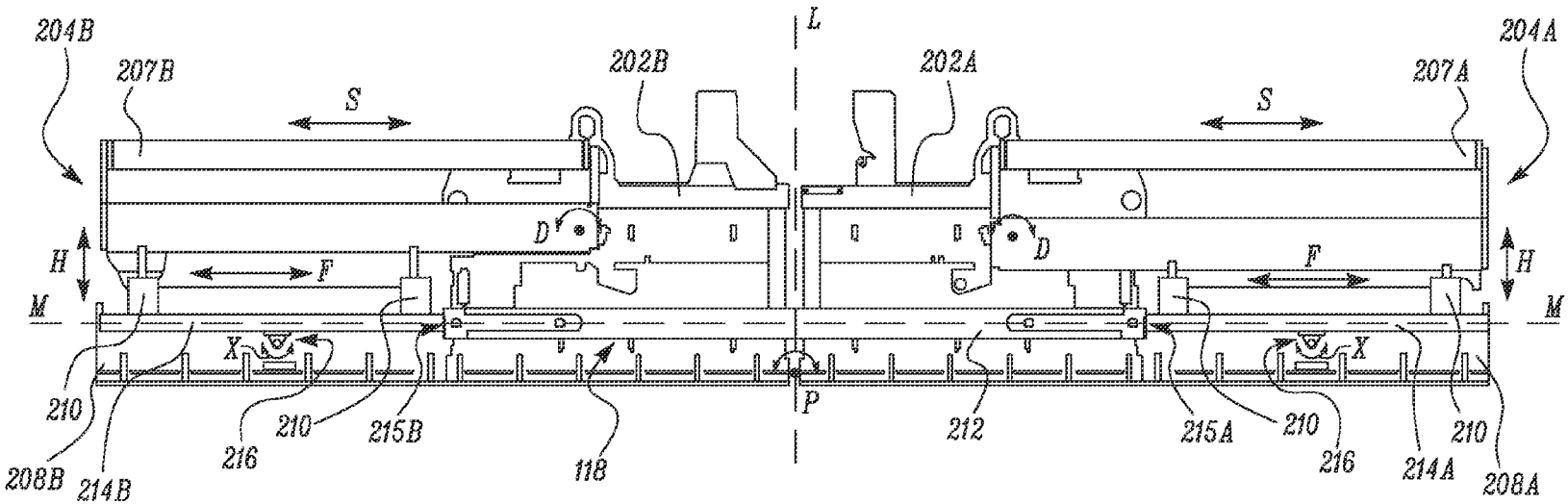
FIG. 4 illustrates a front view of the screed of FIG. 3.

FIG. 3 and FIG. 4 illustrate the screed 102, according to an embodiment of the present disclosure. Some components of the screed 102 are not shown for clarity. As illustrated in FIG. 3 and FIG. 4, the screed 102 includes the first main frame 202A, the second main frame 202B, the first extender frame 204A, and the second extender frame 204B. The first and second main frames 202A, 202B, and the first and second extender frames 204A, 204B are adjustable similar to the first and second main sections 104A, 104B, and the first and second extender screeds 106A, 106B, respectively, as described before with reference to FIG. 1 and FIG. 2. Therefore, the first and second main frames 202A, 202B are pivotable about the axis "P". Further, the first and second extender frames 204A, 204B are adjustable along the direction "S" and about the axis "D" relative to the first and second main frames 202A, 202B.

As illustrated in FIG. 3, the first extender frame 204A is offset by a first offset distance 206 relative to the second extender frame 204B along an offset direction "O" (hereinafter referred to as the direction "O"). The direction "O" may be oriented substantially perpendicular to the direction "S". The first offset distance 206 enables the first and second extender frames 204A, 204B to be fully retractable relative to the first and second main frames 202A, 202B. In an embodiment, the first offset distance 206 may be substantially equal to or more than a maximum width of each of the first and second extender frames 204A, 204B along the direction "O". The fully retractable configuration may enable the screed 102 to pave surfaces ranging approximately from a paving length of the main screed 104 (illustrated in FIG. 1 and FIG. 2) to a total paving length of the main screed 104, and the first and second extender screeds 106A, 106B (illustrated in FIG. 1 and FIG. 2). The fully retractable configuration may also facilitate transport of the screed 102.

Further, the first extender frame 204A includes a first upper part 207A and a first lower part 208A. Similarly, the second extender frame 204B includes a second upper part 207B and a second lower part 208B. Further, as illustrated in FIG. 3, the first and second lower parts 208A, 208B are connected to the first and second upper parts 207A, 207B by telescopic connections 210. The telescopic connections 210 may enable the first and second lower parts 208A, 208B to be adjusted relative to the first and second upper parts 207A, 207B, respectively, along the direction "H".

As illustrated in FIG. 3 and FIG. 4, the walkway 118 includes a main walkway 212, a first extender walkway 214A, and a second extender walkway 214B. The first and second extender walkways 214A, 214B are slidably connected to the main walkway 212. Further, the main walkway 212 includes first and second ends 215A, 215B that slidably receive the first and second extender walkways 214A, 214B, respectively. The first and second extender walkways 214A, 214B are extendable and retractable relative to the main walkway 212 along a walkway sliding direction "F" (hereinafter referred to as the direction "F"). The direction "F" may be substantially perpendicular to the axis "P". Further, walkway supports 216 connect the first and second extender walkways 214A, 214B to extender brackets 218 of the first and second lower parts 208A, 208B. In an embodiment, the walkway support 216 enables the first extender walkway 214A and the first lower part 208A to pivot relative to each other about a walkway pivot axis "X" (hereinafter referred to as the axis "X"). Similarly, the second extender walkway 214B and the second lower part 208B pivot relative to each other about the axis "X". In a further embodiment, the axis "X" may be substantially perpendicular to the direction "F". Further, the axis "X" may be substantially parallel to the axis "P". In an embodiment of the present disclosure, the walkway 118 is pivotable relative to the screed 102 about a walkway folding axis "Y" (hereinafter referred to as the axis "Y") between an lowered state (illustrated in FIG. 7) and a raised state (illustrated in FIG. 8). In an embodiment, the axis "Y" may be substantially perpendicular to the axis "X". Various details of the walkway 118 will now be described with reference to FIGS. 5-9.

Figure 5:
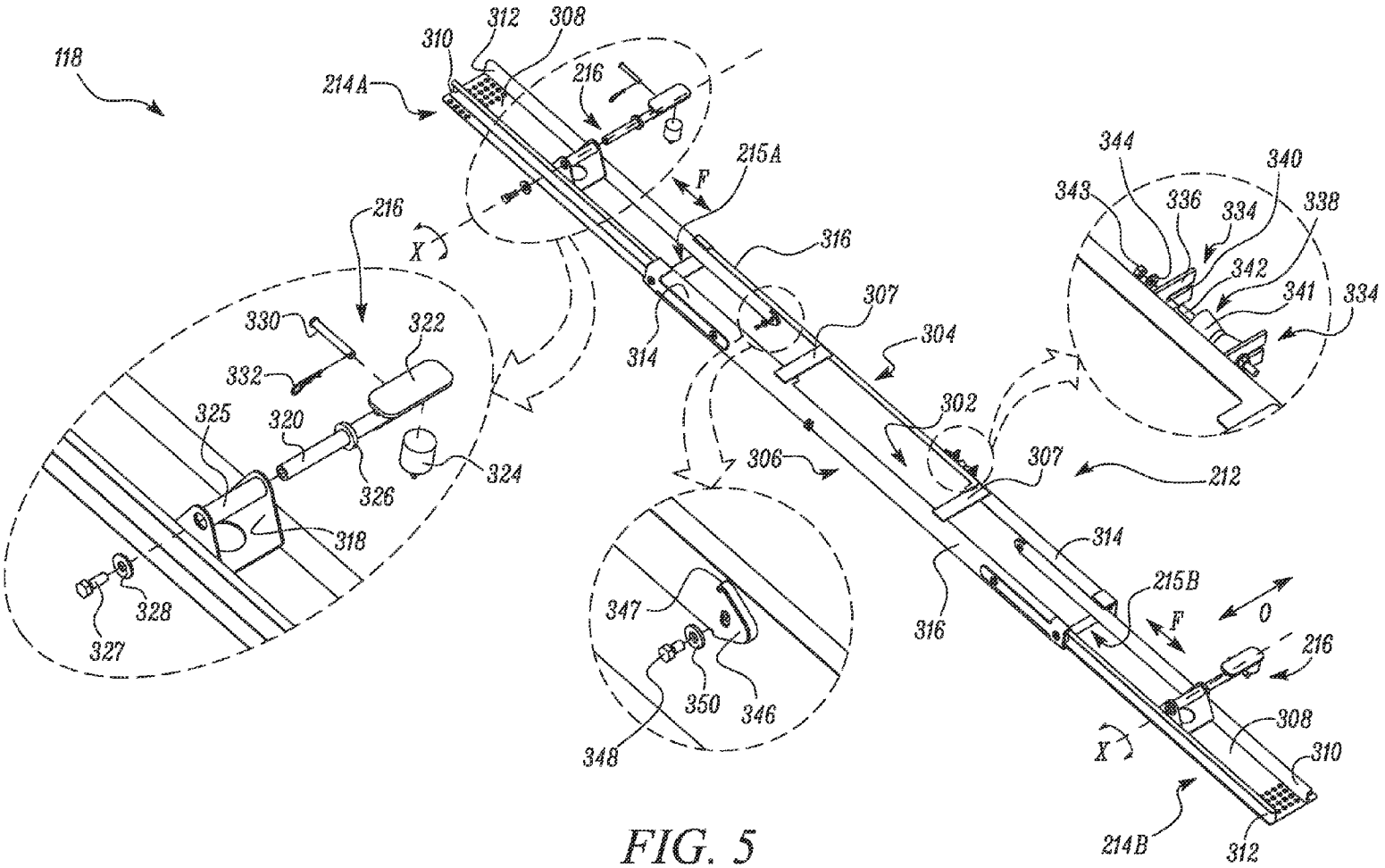
FIG. 5 illustrates a perspective view of the bottom of the walkway in an extended configuration.
Figure 6:
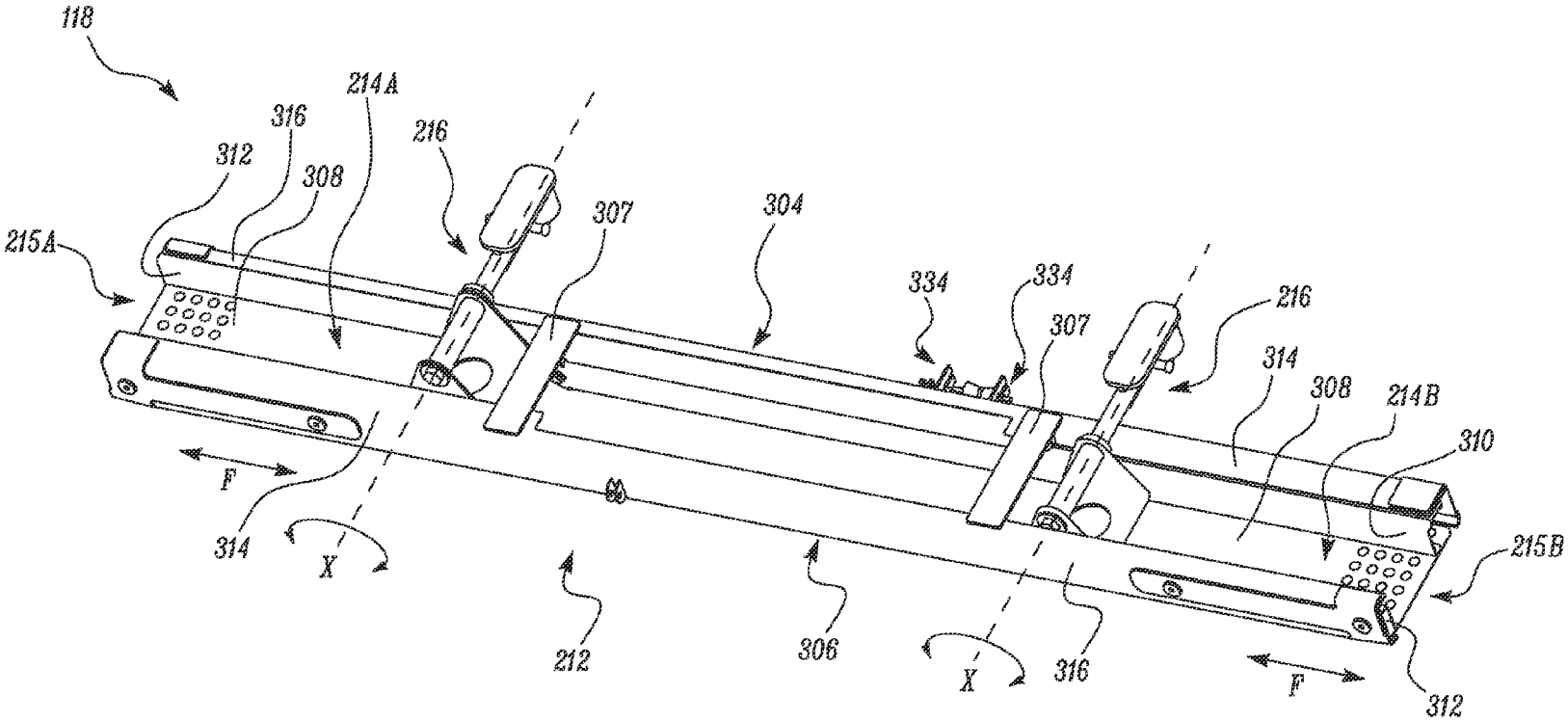
FIG. 6 illustrates a perspective view of the bottom of the walkway in a retracted configuration.

Looking at the walkway 118 from the bottom, FIG. 5 and FIG. 6 illustrate the walkway 118 in a fully extended configuration and a fully retracted configuration, respectively, according to an embodiment of the present disclosure. In the fully retracted configuration, the first and second extender walkways 214A, 214B are fully retracted within the main walkway 212. In an embodiment, the extended position of the walkway 118 may correspond with the fully extended configuration of the screed 102. Similarly, the retracted configuration of the walkway 118 may correspond with the fully retracted configuration of the screed 102. In an embodiment, a length of the walkway 118 in the fully extended configuration may be approximately twice a length in the fully retracted configuration.

Further, the main walkway 212 includes a main planar portion 302 and two housings 304, 306 that extend from the main planar portion 302. Two transverse supports 307 couple the housings 304, 306 to each other. Further, each of the first and second extender walkways 214A, 214B includes an extender planar part 308 and two engagement portions 310, 312 that extend from the extender planar part 308. In an embodiment, the housings 304 and 306, and the engagement portions 310 and 312 may be C-shaped. However, the housings 304 and 306, and the engagement portions 310 and 312 may be of any other shape, for example, curved, so long as proper alignment and engagement is maintained.

Each of the housings 304, 306 includes a first portion 314 and a second portion 316. The first portions 314 are located proximate the first and second ends 215A, 215B that receive the first and second extender walkways 214A, 214B, respectively. Further, a width of each first portion 314 is higher than that of each second portion 316. Thus, each of the first and second extender walkways 214A, 214B are received at least partly in one of the first portions 314 and one of the second portions 316. In an embodiment, the first portions 314 of the housings 304, 306 at least partly receive the engagement portions 310 of the first and second extender walkways 214A, 214B, respectively. Further, the second portions 316 of the housings 304, 306 at least partly receive the engagement portions 312 of first and second extender walkways 214A, 214B, respectively. The difference in widths of the first portions 314 and the second portion 316 may facilitate a second offset along the direction "O" (illustrated with reference to FIG. 7 and FIG. 8) between the first and second extender walkways 214A, 214B. Further, the second offset enables the first and second extender walkways 214A, 214B to be in fully retracted configuration (illustrated in FIG. 6).

FIG. 5 illustrates a detailed exploded view of one of the walkway supports 216. The walkway support 216 includes a walkway bracket 318, a tube 320, a support arm 322, and a vibration damper 324. The walkway bracket 318 includes a hollow portion 325 that receives the tube 320. A stop 326, provided on the tube 320, limits a length of insertion of the tube 320 within the hollow portion 325. A bolt 327 and the washer 328 attach the tube 320 to the walkway bracket 318. The support arm 322 may be attached to the tube 320 by welding, brazing, adhesives, or the like. Alternatively, the support arm 322 may be integrally formed with the tube 320. A pin 330 connects the support arm 322 to the extender bracket 218 (described with reference to FIG. 7 and FIG. 8). Further, a pin locking member 332 may secure the pin 330 in place. In an embodiment, the pin locking member 332 may be a cotter pin and the pin 330 may include an aperture that receives the cotter pin. Further, the vibration damper 324 may be connected to each of the first and second lower parts 208A, 208B (illustrated in FIG. 7 and FIG. 8).

In an embodiment of the present disclosure, the walkway bracket 318 and the tube 320 are pivotable relative to each other. Therefore, the first and second extender walkways 214A, 214B and the first and second lower parts 208A, 208B, respectively, pivot relative to each other about the axis "X". The tube 320 and/or the hollow portion 325 may include a low friction coating to facilitate movement about the axis "X" and minimize wear. Alternatively, the tube 320 and/or the hollow portion 325 may be made of a low friction material, such as, a bronze alloy. A low friction material (for example, grease) may also be provided at an interface between the tube 320 and the hollow portion 325.

As illustrated in FIG. 5, the main walkway 212 includes two main supports 334. One of the main supports 334 is illustrated in detail. The main support 334 includes a projection 336 and a coupling member 338. The projection 336 may be attached to the main walkway 212. The projection 336 includes a slot 340. Further, the coupling member 338 includes a body portion 341 and a connecting portion 342 located at an end of the body portion 341. In an embodiment, the coupling member 338 may be at least partially made of an elastomeric material, such as, rubber. As illustrated in FIG. 5, the slot 340 receives the connecting portion 342. Further, a nut 343 and a washer 344 attach the connecting portion 342 to the projection 336. In an embodiment, the body portion 341 may be attached to corresponding member (not illustrated) of the main screed 104.

In an embodiment, as illustrated in FIG. 5, a retaining member 346 is attached to an end 347 of the engagement portion 312 by a bolt 348 and a washer 350. Similar retaining members 346 may be attached to the engagement portions 310, 312 of the first and second extender walkways 214A, 214B. The retaining members 346 may prevent the first and second extender walkways 214A, 214B from disengaging from the main walkway 212.

Figure 7:
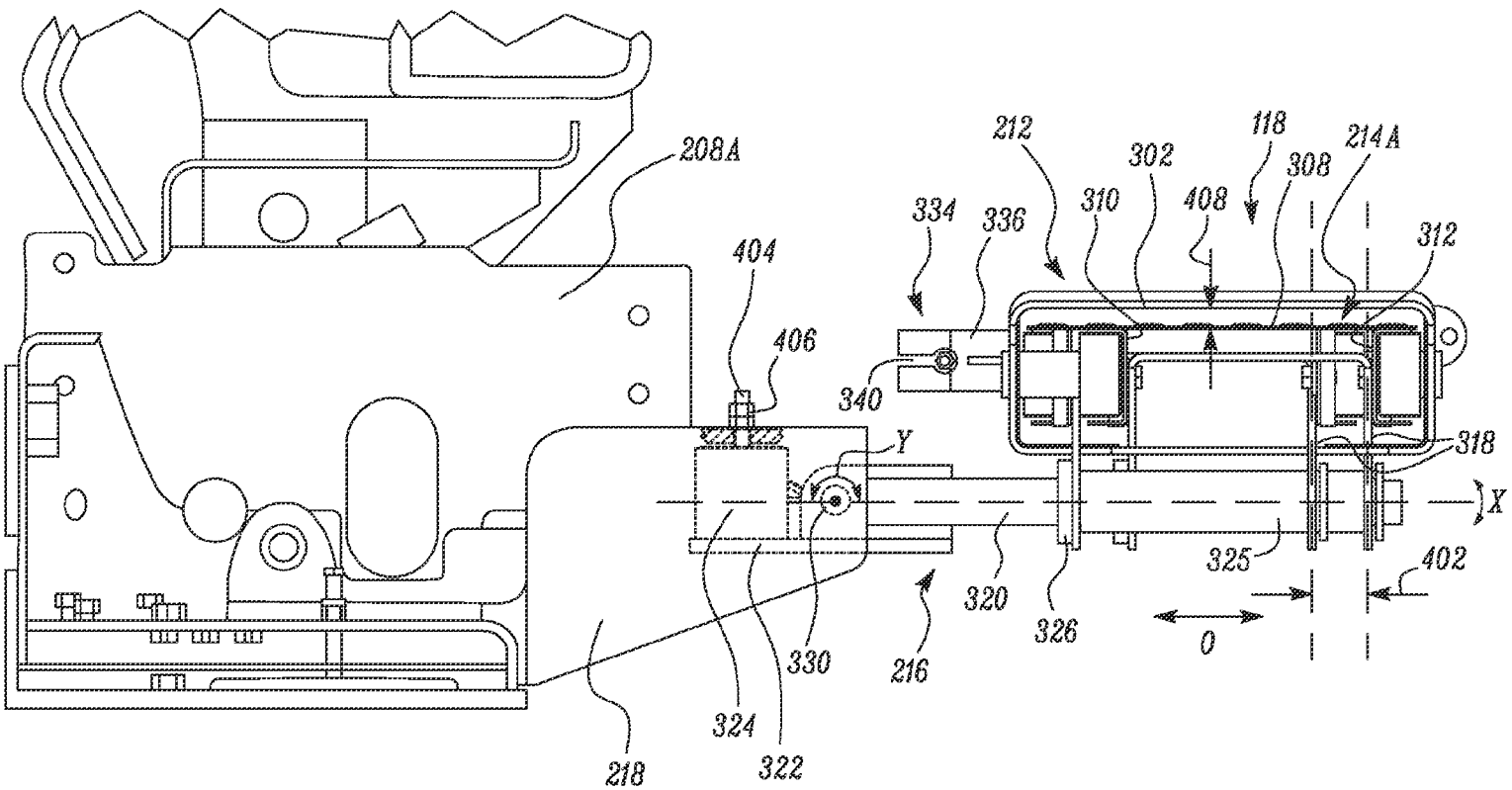
FIG. 7 illustrates a side view of the walkway in a lowered state.
Figure 8:
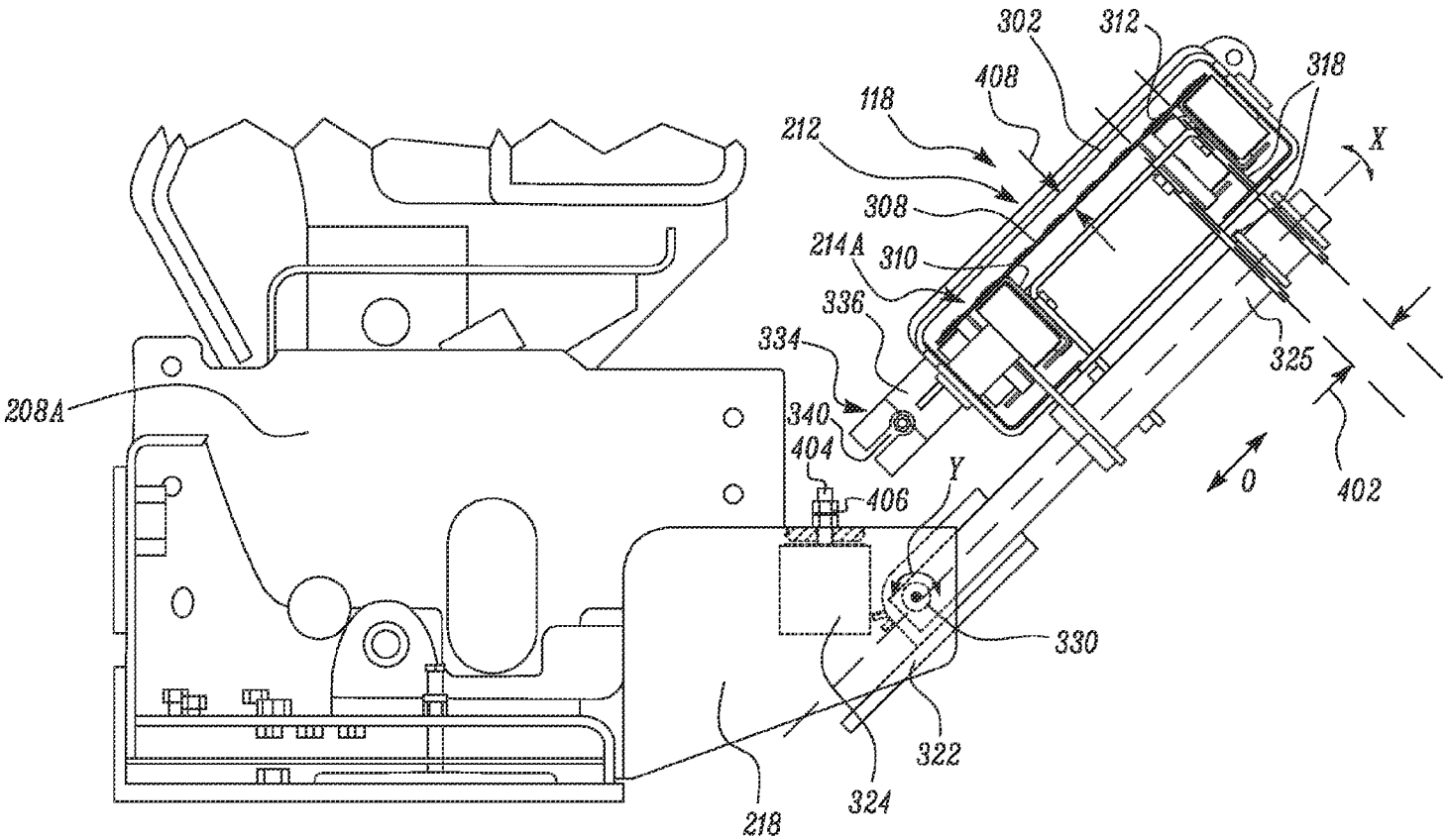
FIG. 8 illustrates a side view of the walkway in a raised state.

FIG. 7 and FIG. 8 illustrate side views of the walkway 118 connected to the first and second lower parts 208A, 208B (only the first lower part 208A is illustrated), according to an embodiment of the present invention. As illustrated in FIG. 7 and FIG. 8, the pin 330 pivotably connects the support arm 322 (illustrated in FIG. 5) to the extender bracket 218. Therefore, the walkway 118 is pivotable about the axis "Y" between the lowered state (illustrated in FIG. 7) and the raised state (illustrated in FIG. 8). Further, as illustrated in FIG. 7, an offset is present between the walkway brackets 318. This offset is substantially equal to the second offset since the walkway brackets 318 are connected to the respective first and second extender walkways 214A, 214B (only the first extender walkway 214A illustrated in FIG. 7 and FIG. 8). Further, the walkway brackets 318 are offset by a second offset distance 402.

As illustrated in FIG. 7, the vibration damper 324 includes a coupling part 404 that is attached to the extender bracket 218 by a fastener 406. In an embodiment, a clearance may be provided between the extender bracket 218 and the vibration damper 324. Further, the vibration damper 324 may be at least partially made of an elastomeric material, such as, rubber. Moreover, in the lowered state, the vibration damper 324 may rest upon the support arm 322. However, in the raised state, as illustrated in FIG. 8, the vibration damper 324 remains fixed, while the support arm 322 pivots about the axis "Y". Further, in an alternative embodiment, the walkway bracket 318 may be attached to the engagement portions 310 and 312 by welding, brazing, fasteners, adhesives, or the like. However, the walkway brackets 318 may be joined to the any other part of the first and second extender walkways 214A, 214B. Alternatively, the walkway bracket 318 may be integrally formed with the first and second extender walkways 214A, 214B. In an embodiment, as illustrated in FIG. 7, a step 408 is provided between the main planar portion 302 and the extender planar part 308. The step 408 may facilitate a smooth sliding of the first and second extender walkways 214A, 214B.

Figure 9:
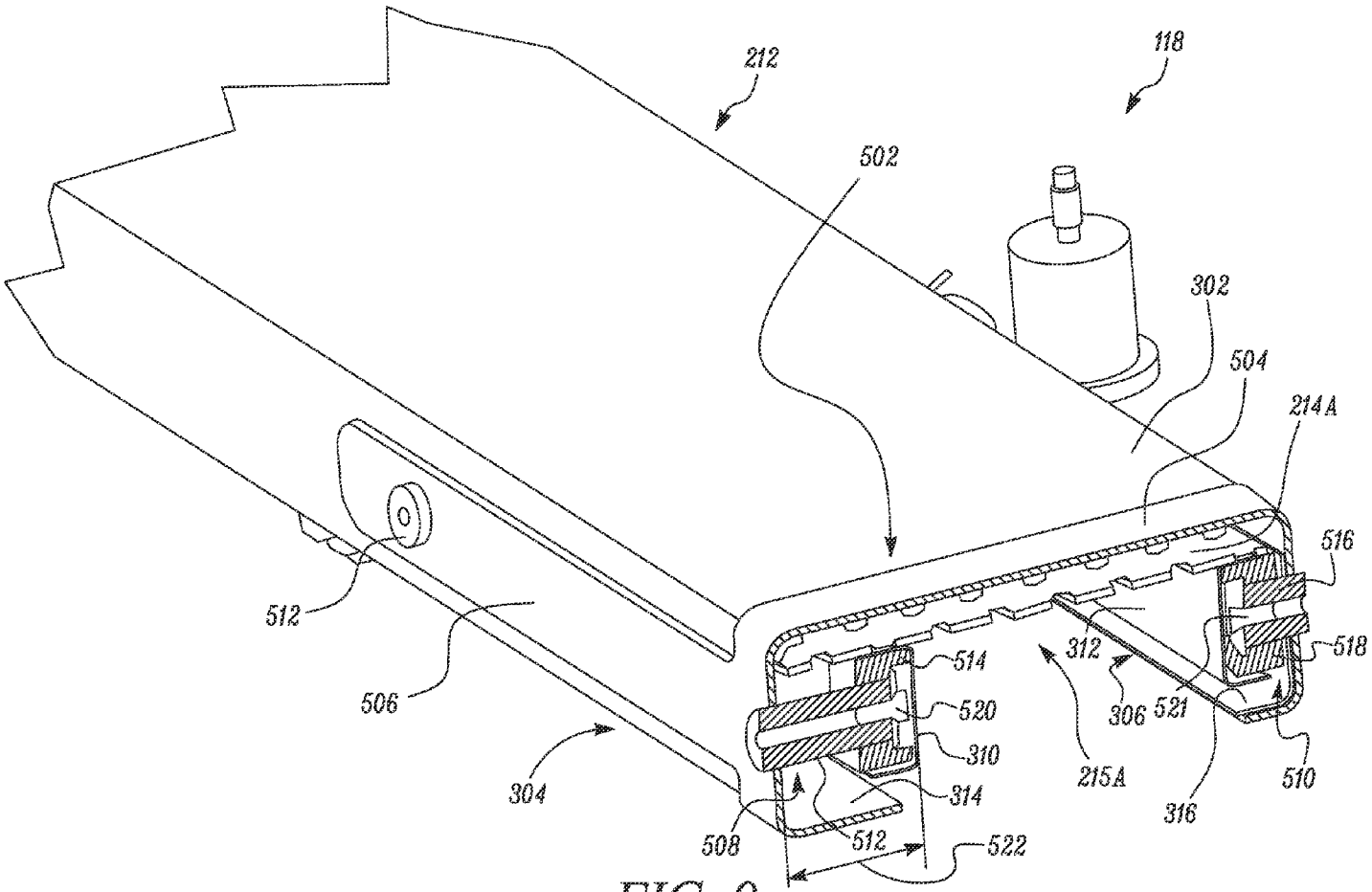
FIG. 9 illustrates a sectional view of the walkway.

FIG. 9 illustrates a sectional view of the walkway 118 at the first end 215A of the main walkway 212. As illustrated in FIG. 9, the main walkway 212 includes the housings 304 and 306. The first portion 314 of the housing 304 and the second portion 316 of the housing 306 are illustrated in the figure. The width of the first portion 314 is wider than the width of the second portion 316. A support member 502 includes an end portion 504 and two elongate portions 506 (only one illustrated in FIG. 9). The end portion 504 contacts the main planar portion 302 and the housings 304 and 306 at the first end 215A. The elongate portions 506 contact a length of the housings 304 and 306. Two first slider couplers 508 (one illustrated in FIG. 9) slidably couple the housing 304 to the engagement portion 310. Further, two second slider couplers 510 (one illustrated in FIG. 9) slidably couple the housing 306 to the engagement portion 312. One of the first slider couplers 508 may be located near the first end 215A, while the other first slider coupler (not illustrated) may be located distal to the first end 215A. Similarly, one of the second slider couplers 510 may be located near the first end 215A, while the other second slider coupler (not illustrated) may be located distal to the first end 215A. Each of the first slider couplers 508 includes a first slider pin 512 and a first slider pad 514. Two first slider pins 512 connect the support member 502 to the housing 304. One of the first slider pins 512 is connected to the end portion 504, while the other first slider pin 512 is connected to the elongate portion 506. Each of the second slider couplers 510 includes a second slider pin 516 and a second slider pad 518. The second slider pins 516 connect the support member 502 to the housing 306. One of the second slider pins 516 is connected to the end portion 504, while the other second slider pin (not illustrated) is connected to the elongate portion 506. Further, the first and second slider pads 514, 518 are disposed between the first and second slider pins 512, 516, and the engagement portions 310 and 312, respectively. Therefore, the engagement portions 310 and 312 slide on the first and second slider pads 514, 518, respectively. Further, a first bolt 520 may attach each of the first slider pads 514 to each of the first slider pins 512. Similarly, a second bolt 521 may attach each of the second slider pads 518 to each of the second slider pins 516. In an embodiment, the first and second slider pads 514, 518 may include a low friction coating to facilitate sliding motion of the engagement portions 310 and 312. Alternatively, the first and second slider pads 514, 518 may be made of a low friction material, such as, a bronze alloy, a non-metallic material (E.g., nylon), or the like. A low friction material (for example, grease) may also be provided at an interface between the first and second slider pads 514, 518, and the engagement portions 310 and 312, respectively. In an embodiment, the retaining members 346 (illustrated in FIG. 5) may engage with the first and second slider pads 514, 518, located distal to the first and second ends 215A and 215B, in a fully extended configuration of the walkway 118. This may prevent disengagement of the first and second extender walkways 214A, 214B from the main walkway 212.

As illustrated in FIG. 9, a length of each of the first slider pins 512 may be higher than a length of each of the second slider pins 516. The first slider pins 512 result in a lateral gap 522 between the engagement portion 310 of the first extender walkway 214A and the housing 304. The width of the first portion 314 may also accommodate the lateral gap 522. A length of each of the first slider pads 514 and/or the first bolts 520 may also be different from a length of each of the second slider pads 518 and/or the second bolts 521. At the second end 215B of the main walkway 212, the locations of the first and second portions 314, 316, and the first and second slider couplers 508, 510 may be reversed relative to that illustrated in FIG. 9. This may result in the second offset between the first and second extender walkways 214A, 214B. In an embodiment, a difference in lengths between the first and second slider pins 512, 516 may be substantially equal to the second offset distance 402 (illustrated in FIG. 7). Further, in the fully retracted configuration (as illustrated in FIG. 6) of the walkway 118, the engagement portion 312 of the second extender walkway 214B (not illustrated in FIG. 9) may enter the lateral gap 522. Similarly, the engagement portion 312 of the first extender walkway 214A may enter the lateral gap (not illustrated) between the engagement portion 310 of the second extender walkway 214B and the housing 306.

INDUSTRIAL APPLICABILITY

The present disclosure relates to the paving machine 100 which includes the screed 102. The paving machine 100 may include a hopper (not illustrated) configured to receive paving material from a dump truck. A conveyor (not illustrated) of the paving machine 100 may transfer the paving material from the hopper for discharge onto the roadbed. One or more augers (not illustrated) may spread the paving material. The screed 102 may level and compact the paving material. The screed 102 includes the walkway 118 which may enable one or more operators to observe a paving operation and to also access the one or more user interfaces disposed on the screed 102.

Referring to FIG. 3 and FIG. 4, the screed 102 includes the first and second main frames 202A, 202B, and the first and second extender frames 204A, 204B. The first and second main frames 202A, 202B are pivotable about the axis "P" at the center line "L". The pivoting about the axis "P" may be referred to as the crown motion of each of the first and second main frames 202A, 202B. The first and second extender frames 204A, 204B are extendable and retractable relative to the first and second main frames 202A, 202B, respectively, along the direction "S". The extension and retraction along the direction "S" may be referred to as the sliding motion of each of the first and second frames 202A, 202B. Further, the first and second extender frames 204A, 204B are pivotable relative to the first and second main frames 202A, 202B, respectively, about the axis "D". The pivoting about the axis "D" may be referred to as the slope motion of each of the first and second extender frames 204A, 204B. The first and second extender frames 204A, 204B include the first and second upper parts 207A, 207B, and the first and second lower parts 208A, 208B, respectively. The first and second lower parts 208A, 208B are vertically adjustable relative to the first and second upper parts 207A, 207B, respectively, along the direction "H". The movement along the direction "H" may be referred to the height motion of each of the first and second extender frames 204A, 204B. As illustrated in FIG. 4, the first and second extender frames 204A, 204B may be in a fully extended condition. Further, the magnitudes of the crown, slope and height motions may be substantially zero in FIG. 4. Further, an alignment line "M" passing through the walkway 118 may indicate that the main walkway 212, and the first and second extender walkways 214A, 214B are substantially aligned along a straight line.

Referring to FIG. 3 and FIG. 4, the walkway 118 includes the main walkway 212, and the first and second extender walkways 214A, 214B slidably connected to the main walkway 212. Further, the walkway supports 216 connect the first and second extender walkways 214A, 214B to the first and second extender frames 204A, 204B, respectively. The first and second extender walkways 214A, 214B may slide along the direction "F" to accommodate the sliding motions of the first and second extender frames 204A, 204B. The walkway supports 216 enable the first and second extender walkways 214A, 214B, and the first and second extender frames 204A, 204B, respectively, to pivot relative to each other about the axis "X". The first and second extender walkways 214A, 214B may pivot about the axis "X" to adjust to the various ranges of the crown motions, the slope motions, the height motions, sliding motions, or a combination thereof, as will be described hereinafter with reference to FIGS. 10-13. All the motions in FIGS. 10-13 are illustrated with the configuration of FIG. 4 considered as a reference.

Figure 10:
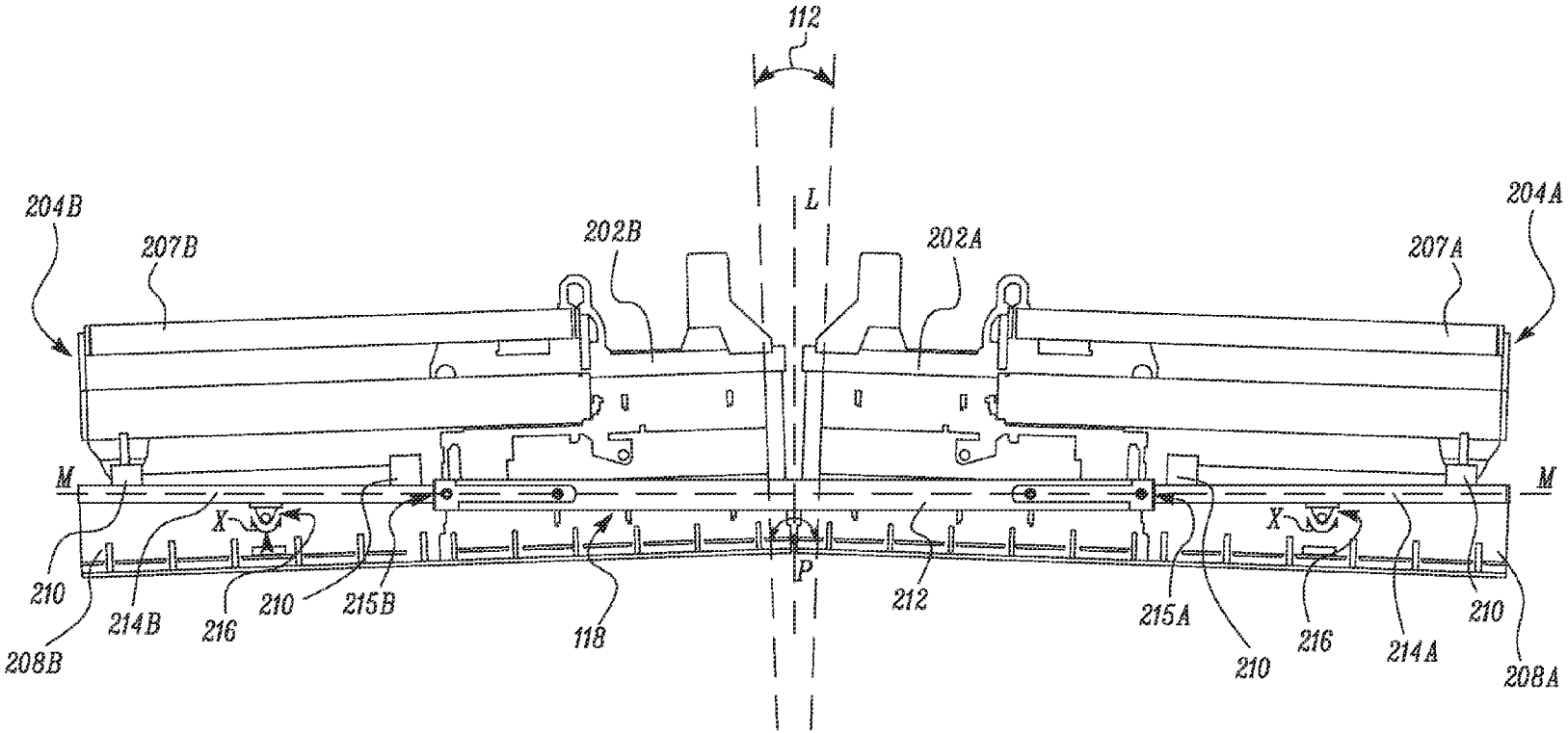
FIG. 10 illustrates crown motions of a first main frame and a second main frame.

FIG. 10 illustrates the crown motions of the first and second main frames 202A, 202B. The first and second main frames 202A, 202B are inclined at the crown angle 112, respectively, relative to the center line "L". The first and second extender frames 204A, 204B are also inclined along with the first and second main frames 202A, 202B. However, the main walkway 212, and the first and second extender walkways 214A, 214B may be substantially aligned along the alignment line "M".

Figure 11:
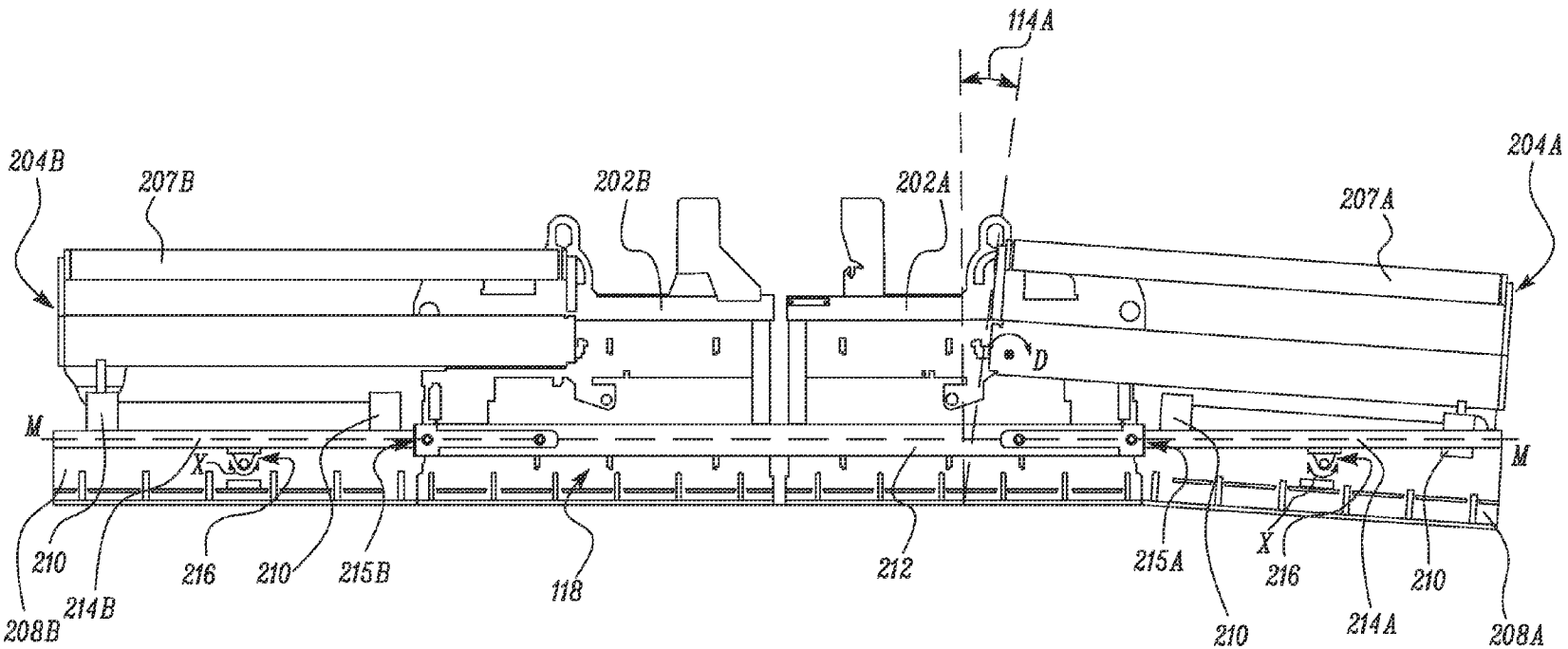
FIG. 11 illustrates slope motion of a first extender frame.

FIG. 11 illustrates the slope motion of the first extender frame 204A. The first extender frame 204A is inclined at the first slope angle 114A relative to the first main frame 202A. However, the main walkway 212, and the first and second extender walkways 214A, 214B may be substantially aligned along the alignment line "M".

Figure 12:
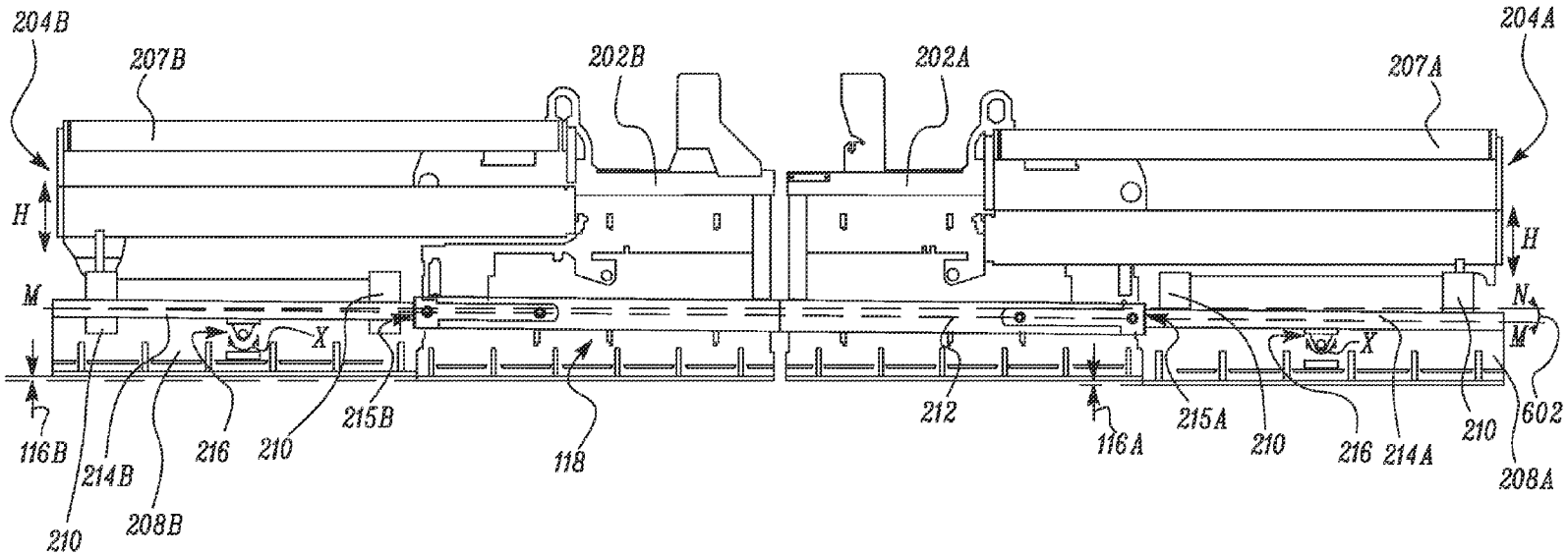
FIG. 12 illustrates height motions of a first extender frame and a second extender frame.

FIG. 12 illustrates height motions of the first and second extender frames 204A, 204B. The first lower part 208A is displaced downwardly along the direction "H" by the first height 116A. Further, the second lower part 208B is displaced upwardly along the direction "H" by the second height 116B. However, the main walkway 212, and the first and second extender walkways 214A, 214B may be substantially aligned along the alignment line "M". The alignment line "M" is inclined by a walkway inclination angle 602 relative to a horizontal line "N". This may indicate that the walkway 118 is inclined due to the difference in positions of the walkway supports 216 along the direction "H".

Figure 13:
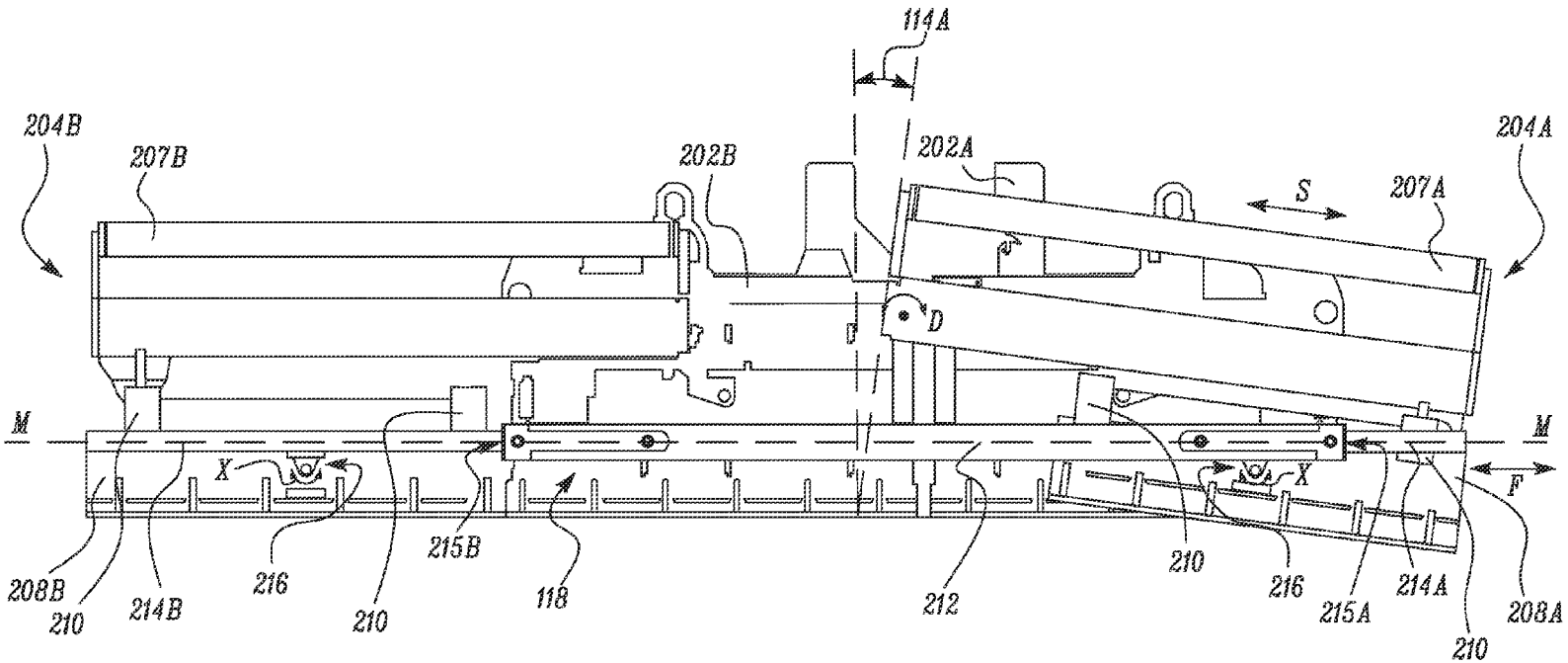
FIG. 13 illustrates combined slope motion and sliding motion of the first extender frame.

FIG. 13 illustrates combined slope and sliding motions of the first extender frame 204A. The first extender frame 204A is in a retracted configuration relative to the first main frame 202A. Further, the first extender frame 204A is inclined at the first slope angle 114A relative to the first main frame 202A. However, the main walkway 212, and the first and second extender walkways 214A, 214B may be may be substantially aligned along the alignment line "M".

Further, the first and second slider pads 514, 518 (illustrated in FIG. 9) may substantially prevent relative rotation between the first and second extender walkways 214A, 214B, and the main walkway 212. Therefore, the main walkway 212, and the first and second extender walkways 214A, 214B may be substantially aligned along the alignment line "M" in various configurations of the first and second main frames 202A, 202B, and the first and second extender frames 204A, 204B. Consequently, one or more operators may be able to conveniently move and stand on the walkway 118. Further, the inclination angle 602 may also be within a small range so as not to interfere with any movements or upright positions of one or more operators on the walkway 118.

Further, the vibration dampers 324 and/or the coupling members 338 may substantially reduce vibrations transmitted from the screed 102 to the walkway 118. Thus, the walkway 118 may provide a more stable support to one or more operators.

As illustrated in FIG. 7 and FIG. 8, the walkway 118 is also pivotable about the axis "Y" between the lowered state and the raised state. The raised state of the walkway 118 may facilitate transport and/or storage of the screed 102.

Further, the fully retracted configuration of the walkway 118, as illustrated in FIG. 6, may minimize the step 408 (illustrated in FIG. 7) between the main planar 302 and the extender planar part 308. Thus, the step 408 may not be inconvenient and/or not pose a tripping hazard to one or more operators.

The screed 102, as described above, may be used with various types of paving machines for paving different surfaces. The screed 102 may be towed or front mounted.

Although the embodiments of this disclosure as described herein may be incorporated without departing from the scope of the following claims, it will be apparent to those skilled in the art that various modifications and variations can be made. Other embodiments will be apparent to those skilled in the art from consideration of the specification and practice of the disclosure. It is intended that the specification and examples be considered as exemplary only, with a true scope being indicated by the following claims and their equivalents.

What is claimed is:

1. A walkway for a screed including an extender frame, the walkway comprising:

a main walkway;

an extender walkway coupled to the main walkway and slidable relative to the main walkway along a sliding direction; and a walkway support including:

a first walkway support member coupled to the extender walkway; and a second walkway support member coupled to the extender frame and pivotably coupled to the first walkway support member about a walkway pivot axis oriented substantially perpendicular to the sliding direction, so that the first walkway support member is pivotable relative to the second walkway support member about the walkway pivot axis.

2. The walkway of claim 1 in which the first walkway support member comprises a walkway bracket, and in which the second walkway support member comprises a tube.

3. The walkway of claim 2, wherein the walkway support further comprises a vibration damper.

4. The walkway of claim 1, wherein the walkway is pivotable relative to the screed about a walkway folding axis, the walkway folding axis being substantially perpendicular to the walkway pivot axis.

5. The walkway of claim 1, wherein the extender walkway is at least partially retractable within the main walkway.

6. The walkway of claim 1, wherein the extender walkway comprises a first extender walkway and a second extender walkway disposed on either end of the main walkway, the first extender walkway and the second extender walkway being offset relative to each other along an offset direction, the offset direction is substantially perpendicular to the sliding direction.

7. The walkway of claim 6 further comprises a first slider coupler and a second slider coupler configured to slidably couple each of the first extender walkway and the second extender walkway to the main walkway.

8. A screed comprising:

a main frame;

an extender frame configured to be retractable and extendable relative to the main frame; and a walkway comprising:

a main walkway;

an extender walkway coupled to the main walkway and slidable relative to the main walkway along a sliding direction; and a walkway support including:

a first walkway support member coupled to the extender walkway; and a second walkway support member coupled to the extender frame and pivotably coupled to the first walkway support member about a walkway pivot axis oriented substantially perpendicular to the sliding direction, so that the first walkway support member is pivotable relative to the second walkway support member about the walkway pivot axis.

9. The screed of claim 8 in which the first walkway support member comprises a walkway bracket, and in which the second walkway support member comprises a tube.

10. The screed of claim 9, wherein the walkway support further comprises a vibration damper.

11. The screed of claim 8, wherein the walkway is pivotable relative to the screed about a walkway folding axis, the walkway folding axis being substantially perpendicular to the walkway pivot axis.

12. The screed of claim 8, wherein the extender walkway is at least partially retractable within the main walkway.

13. The screed of claim 8, wherein the extender walkway comprises a first extender walkway and a second extender walkway disposed on either end of the main walkway, the first extender walkway and the second extender walkway being offset relative to each other along an offset direction, the offset direction is substantially perpendicular to the sliding direction.

14. The screed of claim 13 further comprises a first slider coupler and a second slider coupler configured to slidably couple each of the first extender walkway and the second extender walkway to the main walkway.

15. A paving machine comprising:

a tractor; and a screed coupled to the tractor, the screed comprising:

a main frame;

an extender frame configured to be retractable and extendable relative to the main frame; and a walkway comprising:

a main walkway;

an extender walkway coupled to the main walkway and slidable relative to the main walkway along a sliding direction; and a walkway support including:

a first walkway support member coupled to the extender walkway; and a second walkway support member coupled to the extender frame and pivotably coupled to the first walkway support member about a walkway pivot axis oriented substantially perpendicular to the sliding direction, so that the first walkway support member is pivotable relative to the second walkway support member about the walkway pivot axis.

16. The paving machine of claim 15 in which the first walkway support member comprises a walkway bracket, and in which the second walkway support member comprises a tube.

17. The paving machine of claim 16, wherein the walkway support further comprises a vibration damper.

18. The paving machine of claim 15, wherein the walkway is pivotable relative to the screed about a walkway folding axis, the walkway folding axis being substantially perpendicular to the walkway pivot axis.

19. The paving machine of claim 15, wherein the extender walkway is at least partially retractable within the main walkway.

20. The paving machine of claim 15, wherein the extender walkway comprises a first extender walkway and a second extender walkway disposed on either end of the main walkway, the first extender walkway and the second extender walkway being offset relative to each other along an offset direction, the offset direction is substantially perpendicular to the sliding direction.

21. The paving machine of claim 20 further comprises a first slider coupler and a second slider coupler configured to slidably couple each of the first extender walkway and the second extender walkway to the main walkway.

* * * * *